US006945137B1

(12) United States Patent
Hawkins

(10) Patent No.: US 6,945,137 B1
(45) Date of Patent: Sep. 20, 2005

(54) OPENER FOR PULL TOP-TYPE CANS

(76) Inventor: Kerry L. Hawkins, P.O. Box 1244, Columbia, MO (US) 65205-1244

( * ) Notice: Subject to any disclaimer, the term of this patent is extended or adjusted under 35 U.S.C. 154(b) by 0 days.

(21) Appl. No.: 10/626,136

(22) Filed: Jul. 24, 2003

Related U.S. Application Data

(60) Provisional application No. 60/444,324, filed on Jan. 30, 2003, provisional application No. 60/458,082, filed on Mar. 25, 2003, provisional application No. 60/476,919, filed on Jun. 8, 2003.

(51) Int. Cl.[7] ..... B67B 7/16
(52) U.S. Cl. ..... 81/3.55; 81/3.46; 81/3.09; 7/156
(58) Field of Search ..... 81/3.55, 3.46, 81/3.09, 3.57; 7/156

(56) References Cited

U.S. PATENT DOCUMENTS

| | | | | | |
|---|---|---|---|---|---|
| 3,290,967 | A | * | 12/1966 | Stark | 81/3.55 |
| 3,724,297 | A | | 4/1973 | Bucko | |
| 3,954,030 | A | * | 5/1976 | Newton | 81/3.55 |
| D240,188 | S | | 6/1976 | Lytle | |
| 4,167,056 | A | | 9/1979 | Nattel | |
| 4,207,781 | A | | 6/1980 | Greenwood | |
| 4,241,626 | A | | 12/1980 | Hall | |
| 4,287,794 | A | * | 9/1981 | Kubach et al. | 81/3.55 |
| 4,362,071 | A | * | 12/1982 | Coker | 81/3.55 |
| 4,583,429 | A | | 4/1986 | Kroeger et al. | |
| 4,723,465 | A | | 2/1988 | Hughes | |
| 5,018,409 | A | | 5/1991 | Bittel | |
| 5,095,777 | A | | 3/1992 | Osmar et al. | |
| 5,222,265 | A | | 6/1993 | Hermansson | |
| 5,309,794 | A | * | 5/1994 | Kelly | 81/3.55 |
| 5,555,778 | A | | 9/1996 | Otters et al. | |
| 5,833,285 | A | | 11/1998 | Venezia | |
| 5,913,953 | A | | 6/1999 | Eve et al. | |
| 6,070,497 | A | | 6/2000 | Farelli | |
| 6,311,580 | B1 | * | 11/2001 | Nagy | 81/3.55 |
| 6,354,174 | B1 | * | 3/2002 | Korwin | 81/3.55 |

FOREIGN PATENT DOCUMENTS

| | | | | |
|---|---|---|---|---|
| FR | 2778649 | A1 * | 11/1999 | B67B 7/40 |

* cited by examiner

*Primary Examiner*—Joseph J. Hail, III
*Assistant Examiner*—Bryan Muller
(74) *Attorney, Agent, or Firm*—Polster, Lieder, Woodruff & Lucchesi LP

(57) ABSTRACT

A can opener for a pull top-type can includes a body comprising a forward surface, a rear surface, and a bottom surface. The bottom surface is curved to define a rounded heel. The opener includes a starting notch and a finishing notch. The notches are both located along the front of the opener, and the finishing notch is spaced above the starting notch.

20 Claims, 6 Drawing Sheets

OPENER FOR PULL TOP-TYPE CANS

CROSS-REFERENCE TO RELATED APPLICATIONS

This application claims priority to Provisional Application No. 60/444,324 filed Jan. 30, 2003, 60/458,082 filed Mar. 25, 2003 and 60/476,919 filed Jun. 8, 2003, as well as to Disclosure Document No. 525253 filed Jan. 28, 2003 and Disclosure Document No. 5265528 filed Feb. 15, 2003, all of which are incorporated herein by reference.

STATEMENT REGARDING FEDERALLY SPONSORED RESEARCH OR DEVELOPMENT

Not Applicable.

BACKGROUND OF THE INVENTION

My invention is related to openers for food and beverage cans, and, in particular, to an opener for opening cans having pull tabs which are used to pry the can lid off the can.

Pull top cans are often used for items such as cat food, dog food, tuna, canned fruit, pudding, and numerous single serving products. As is known, the pull top can includes a pull tab on the can lid. The pull tab enables the can lid to be pried open and lifted off the can, providing access to the contents of the can without the use of a can opener. However, it is often difficult to raise the pull tab off the surface of the lid. Additionally, once the pull tab has been raised to a position where the seal of the can has been broken, it can be difficult to remove the lid from the can. The difficulty in opening such cans is increased for those with long nails, with disabilities, such as arthritis, or otherwise simply lack the strength or coordination to open a pull tab type can.

Various different openers have been provided. However, the currently commercially available openers of which I am aware suffer from several drawbacks. Some are difficult to use and, in fact, do not make opening of the can any easier. Others do not adequately grip the can lid, and the can lid can spring off the opener when the can lid is pried off the can.

BRIEF SUMMARY OF THE INVENTION

Briefly stated, a can opener for a pull top-type can includes a body, preferably at the end of a handle. The body comprises a forward surface, a rear surface, and a bottom surface. The bottom surface is curved to define a rounded heel. The heel preferably has a changing radius, with a first radius along a forward portion of the heel and a second radius along the rear portion of the heel; and wherein the forward portion radius is greater than the rear portion radius. The body also includes a starting notch and a finishing notch spaced vertically above the starting notch. Both the starting and finishing notches are positioned along the front of the body.

The body includes a port which opens into the starting notch. The port includes a flat lower surface which intersects with the body's front surface to define an acute angle. In one variation, the opener includes a second port spaced above the first port and which communicates with the finishing notch. In a second variation, the opener includes a channel which extends upwardly from the starting notch and which communicates with the finishing notch.

In the first variation, the body includes a retainer which extends over the opening into the finishing notch. The retainer can comprise a channel which extends from the finishing notch to the second port or a lip which extends over the retaining notch. If a channel is provided, the channel can be either straight or curved. The channel, in combination with the retaining notch, defines a generally J-shaped retainer. Additionally, the retainer can comprise a movable member having an end which closes the opening to the finishing notch. The moveable member can comprise, for example, a pivotable member. The pivotable member can be a lever positioned on top of the body.

In the second variation, in which the opener includes a single port and a channel extending upwardly from the starting notch, the finishing notch can be located on either a forward or rearward edge of the channel. If the notch is on the forward edge of the channel, the opener can be provided with a rebound slot which extends generally rearwardly from the finishing notch.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
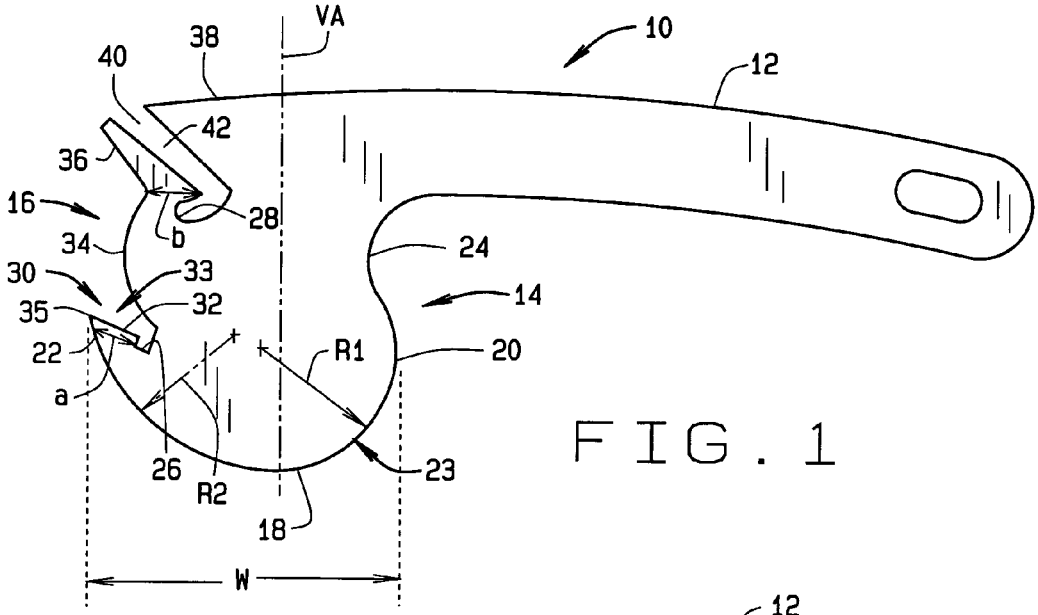
FIG. 1 is a plan view of a first illustrative embodiment of a can opener of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 2:
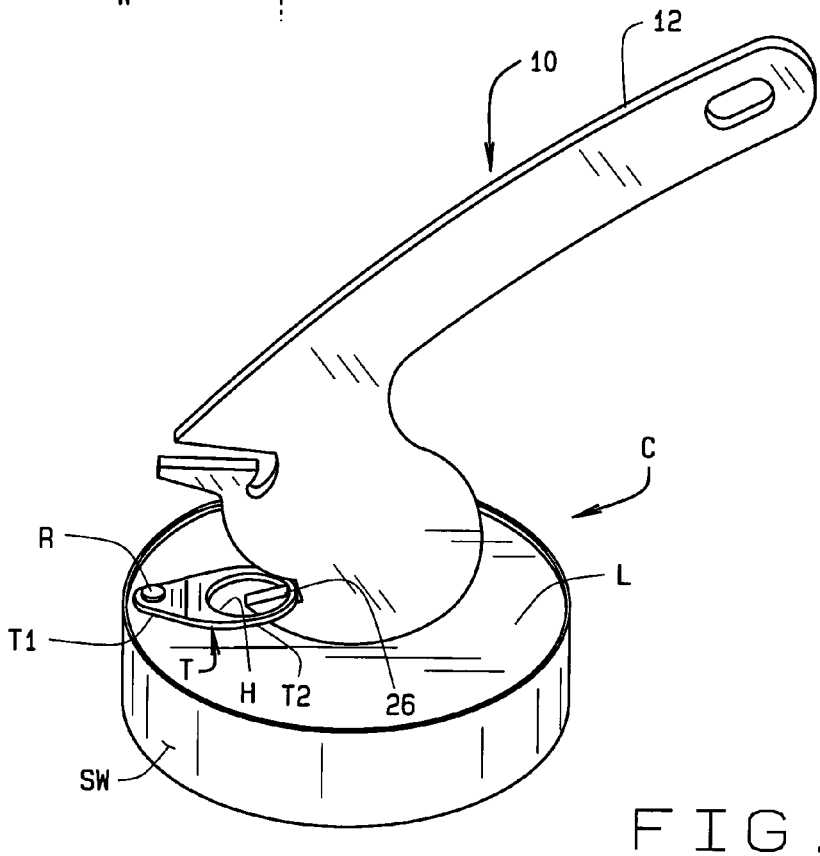
FIG. 2 is a perspective view of the can opener with its starting notch engaging a pull tab of a can.

Referring initially to FIG. 2, a typical pull top-type can C has side walls SW and a lid L. Typically there is a rim extending above the lid defined by the side walls. To enable the can to be opened, and the lid to be removed, without the use of a typical kitchen can opener, the lid is provided with a pull tab T. The pull tab T extends generally radially inwardly from a point near the edge of the lid. The pull tab has a first end T1 that is near the edge of the lid and a second end T2 that is closer to the center of the lid. The pull tab T is secured to the lid by a rivet R near the pull tab first end T1, but spaced radially inwardly slightly from the pull tab first end. A hole H forms a ring at the second end of the tab to allow the tab to be grasped for opening of the can. As is known, to open the can C, the pull tab T is lifted up at its second end until the pull tab first end T1 breaks the seal on the lid. Effectively, by lifting the second end T2, the first end T1 is forced down into the can, and after a predetermined amount of lifting (based on the dimensions of the pull tab and the position of the rivet), the tab first end pushes down on the lid, separating the lid from the can wall where the tab is connected to the can lid to break the seal of the can. When the seal is open (typically when the pull tab forms an angle with the lid of between 45° and 90°), the pull tab is pulled rearwardly or radially (i.e., away from the point of rivet). The lid will then separate from the can, and the user will have access to the contents of the can. It is often difficult to lift up the tab in the first instance, and it is also often difficult to perform the second step to complete opening of the can. The difficulty is increased for example, for someone with long finger nails, who is arthritic, or for someone who otherwise lacks the strength or coordination necessary to lift and pull the tab T. Additionally, sometimes the lid can "spring" causing a mess in the area where the can is opened. As discussed below, the can opener 10 of the present invention facilitates opening of cans.

A first illustrative embodiment of the opener 10 is shown in FIG. 1. The opener 10 includes a handle 12 and a body 14 at the forward end of the handle. The body 14 includes a front 16, a bottom edge 18, and a back edge 20. The bottom edge 18 and back edge 20 are curved. In fact, the bottom edge 18 curves around to join with a front edge 22. The edges 18, 20, and 22 transition smoothly from the edge 22 to the edge 18 to the edge 20 and define a generally U-shaped heel 23 for the body. The curvature defined by the edges 18, 20, and 22 is a French curve—that is, the radius of the curve changes along the length of the curve. Therefore, as can be seen, the radius of the curve along the front edge 22 is greater than the radius of the curve along the bottom edge 18 and back edge 20. For example, the curvature along the back and bottom edges can have a radius R1 of about 1"–2"; and the curvature of the front edge 22 can have a radius R2 at the upper edge of the front surface 22 of about 3"–6". The back edge 20, as seen, curves inwardly just below the handle, to define a concave portion 24 of the back edge. Further, the opener 10 has a front-to-back width W of about 2½" to about 2¾" These dimensions can be changed as desired to enable the opener to be used with cans of different sizes.

At the front 16, the opener 10 has a first or starting notch 26 and a second or finishing notch 28 which is positioned above the starting notch. A first port 30 opens into the starting notch 26. The port 30 is defined by a substantially flat lower surface 32 and a curved forward surface 34 which extends generally perpendicular to the side walls of the notch 26 and generally parallel to the bottom surface the notch 26. As also seen, the surface 32 is sloped relative to a vertical axis VA of the body 14. Hence, the notch 26 also defines an angle with the body vertical axis. The bottom surface of the notch and the port surface 32 both define an angle of about 65° to about 75° with the vertical axis VA.

The port lower surface 32 intersects with the front edge 22, and the front edge 22 and surface 32 define an acute angle. Preferably, the intersection defies a point 35. The area of the body where the port surface 32 and the forward edge 22 intersect defines an anvil 33. The notch 26 is at the back of the surface 32 and drops below the surface 32. The surface 32 is formed such that there is a length "a" between the notch 26 and the surface 22 which is less than the diameter of the hole H in the can's pull tab T, so that the tab hole H can fit over the lip or anvil 33 and be received in the notch 26. Generally, the smallest pull tab's have holes of about ½". Thus, the length "a" preferably is about 7/16" which corresponds to the length of the anvil 33.

A lip 36 extends diagonally upwardly and forwardly from the top of the edge 34. The top surface of the lip 36 is approximately level with, or slightly below, the top edge 38 of body 14. A second port 40 is formed between the lip 36 and the forward end of the body top edge 38, and a channel 42 extends from the port 40 to the finishing notch 28. The channel 42 is shown to be straight and is defined in part by the top surface of the lip 36. The channel 42 slopes downwardly and inwardly, defining an angle of about 45° to about 55° with the body vertical axis VA. The notch 28 curves downwardly and slightly forwardly of the end of the channel 42. The channel is formed such that there is a distance "b" between the rear tip of the lip 36 and the base of the lip 36. This distance "b", like the distance "a", must be less than the diameter of the pull tab hole so that the tab hole can fit over the lip 36 and be received in the notch 28. As with the distance "a", the distance "b" preferably is about 7/16" so that the opener will be able to accommodate most size tabs.

Figure 3A:
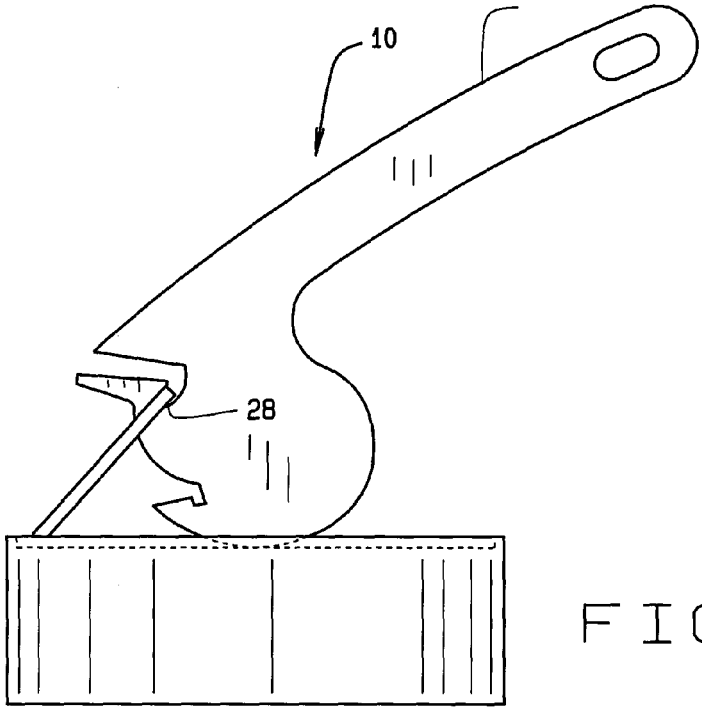
FIG. 3A is a side elevational view of the can opener with its finishing notch engaging the pull tab of the can in the starting position of the second step of opening the can.
Figure 3B:
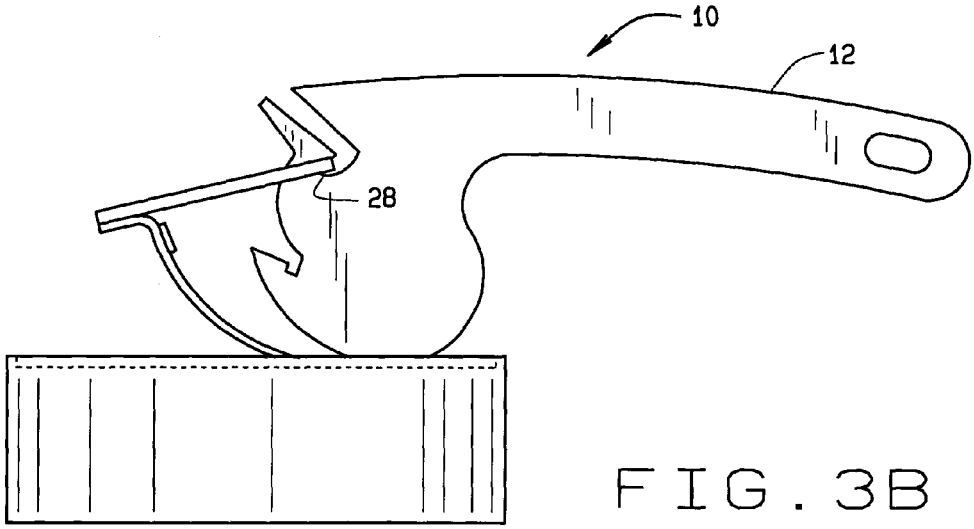
FIG. 3B is a side elevational view of the can opener with its finishing notch engaging the pull tab of the can in the finished position of the second step of opening the can, showing the can opened.

The operation of the opener is shown in FIGS. 2, 3A and 3B. Initially, the anvil tip 35 is urged under the end T2 of the tab T and through the tab hole H until the end edge of the tab is received in the notch 26. When this is done, the handle 12 will be at a substantial angle with respect to the can lid L, as seen in FIG. 2. With the bottom surface 18 resting on the can lid, the handle 10 is pivoted downwardly to pivot the opener body 14 and raise the notch 26. The pivoting of the body 14 relative to the can lid L will cause the opener to raise the end of the pull tab T. The body 14 is rotated until the pull tab T is lifted to a position in which the seal between the can lid L and the can wall W is broken. The pull tab breaks the seal of the can generally when the pull tab T is lifted to an angle of between 45° and 90° relative to the can lid L.

After the tab T has been lifted, the starting notch 26 is disengaged from the pull tab T; and the opener 10 is repositioned to engage the finishing notch 28 with the pull tab T, as seen in FIG. 3A. This is done by passing the lip 36 through the tab hole H until the end of the tab engages the back of the channel 42 or the notch 28. The body heel is then again rested on the can lid L. As can be appreciated, by changing the notch which engages the pull tab T, the rotational position of the body 14 (and hence of the handle 12) is changed. When the first step (i.e., raising the pull tab) is completed, the handle 12 forms a small angle with the can lid L. After repositioning the opener so that the pull tab ring is received in the finishing notch 28 or its port 42, the handle 12 again forms a substantial angle with the can lid L, as seen in FIG. 3A. The handle 12 is again pivoted downwardly to pivot the body 14. As the body 14 pivots, the finishing notch 28 is moved upwardly and rearwardly. This pivoting action of the body causes the notch 28 to raise or lift and remove the can lid L from the can, thereby opening the can, as seen in FIG. 3B.

Depending on the material from which the can lid is made (some can lids are springier than others) and depending on the manner in which the can lid is secured to the can wall, the can lid can spring or bounce, creating a mess. However, the channel 42 forms a retainer which prevents the can from becoming disengaged from the opener. Hence, the lid will stay on the opener, to be removed from the opener by the operator.

Figure 4:
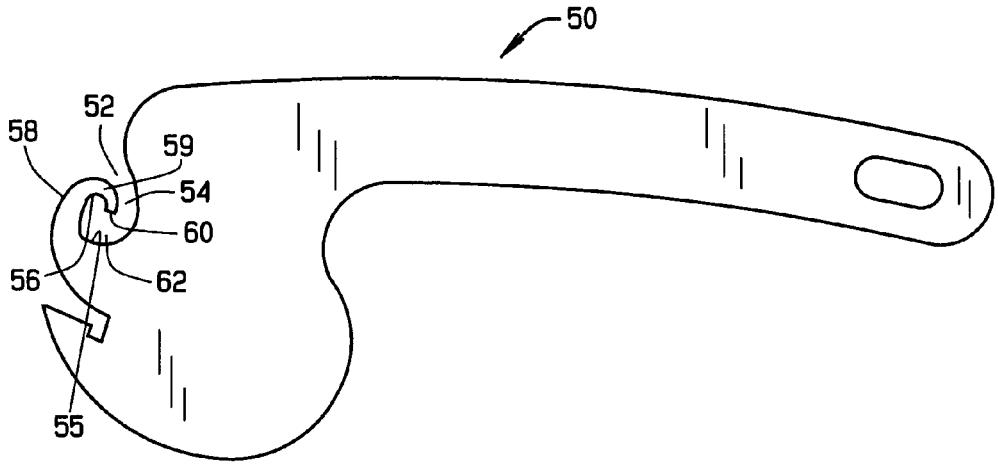
FIG. 4 is a plan view of a second illustrative embodiment of the can opener.

A second embodiment of the opener 50 is shown in FIG. 4. The opener 50 is generally similar to the opener 10. It differs only in the configuration of the finishing notch, the second port, and the retainer. The second port 52 opens generally upwardly. A channel 54 extends from the port 52 to the finishing notch 55 and continues upwardly to a retaining notch 56. The channel 54 is curved (rather than straight) and curves downwardly and forwardly into the finishing notch 55 which engages the pull tab during opening of the lid. The forward edge 58 of the opener leads to a lip 59 which curves around to generally downwardly extending to point 60. The point 60, in conjunction with the bottom edge of the curved channel 54, defines an opening 62 into the finishing notch 55. The opening 62 is shorter than the notch. Hence, the finishing notch 55 has a height greater than the height of the opening 62. The curved lip 59, which extends over the finishing notch 55, forms the retaining notch 56 for the opener. Operation of the opener 50 is substantially identical to operation of the opener 10.

Figure 5:
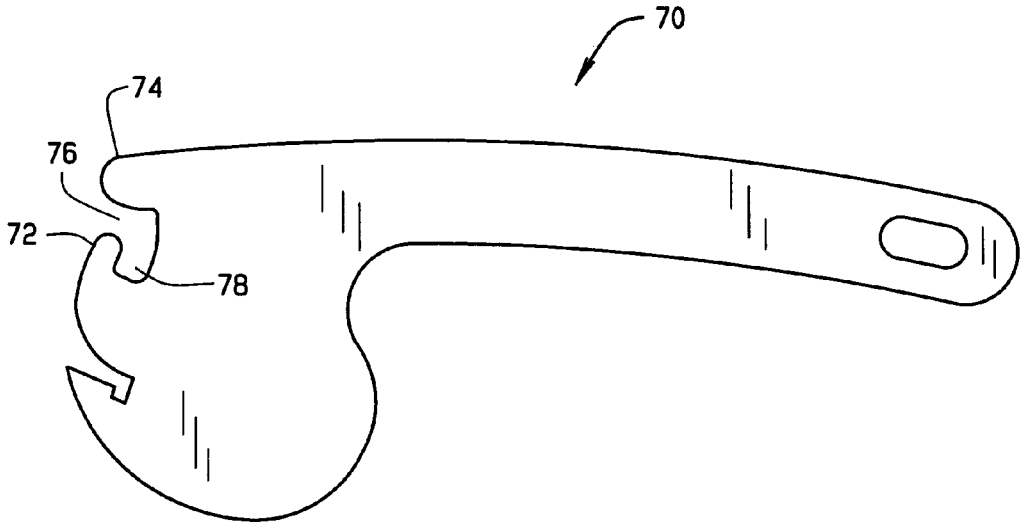
FIG. 5 is a plan view of a third illustrative embodiment of the can opener.

The opener 70 shown in FIG. 5 shows another variation on the finishing port. The opener 70 is otherwise substantially similar to the opener 10. The opener 70 has a generally upwardly directed lip 72 and a forwardly extending lip 74 at the top of the opener body. The lips 72 and 74 define the second port 76 which extends generally rearwardly from the forward edge of the opener. The finishing notch 78 is adjacent the lip 72 and below the lip 74. Hence, the port 76 and notch 78 in combination, form an L-shaped channel. Again, operation of the opener 70 is substantially identical to operation of the opener 10, as described above. In the opener 70, the upper lip 74, which extends over the notch 78 defines the retainer which holds the pull tab on the opener after the lid has been removed from the can.

Figure 6:
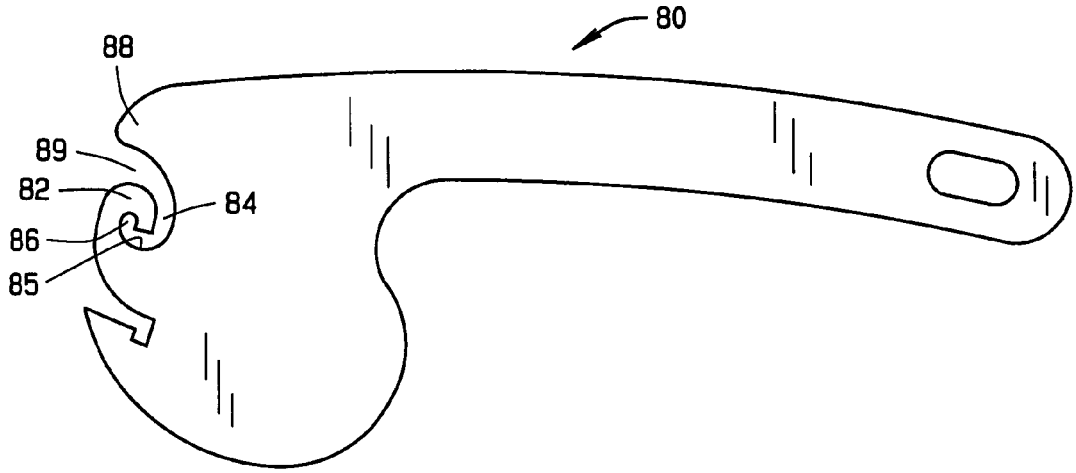
FIG. 6 is a plan view of a fourth illustrative embodiment of the can opener.

The opener 80 of FIG. 6 shows a further variation of the finishing notch and second port. The opener 80 includes a lip 82 which curves similarly to the lip 59 of the opener 50 (FIG. 4) to form a channel 84, the second or finishing notch 85 and the retaining notch 86. However, like the opener 70, the opener 80 also includes a forwardly extending upper lip 88, such that the port 90 is a more forwardly opening port (as opposed to a more upwardly opening port). The upper lip 88 gives the channel 84 a more spiral appearance. In the opener 80, the curved channel 84 and the lip 82, in combination, form the retaining notch 86 which holds the lid on the opener after the lid has been removed from the can.

Figure 7:
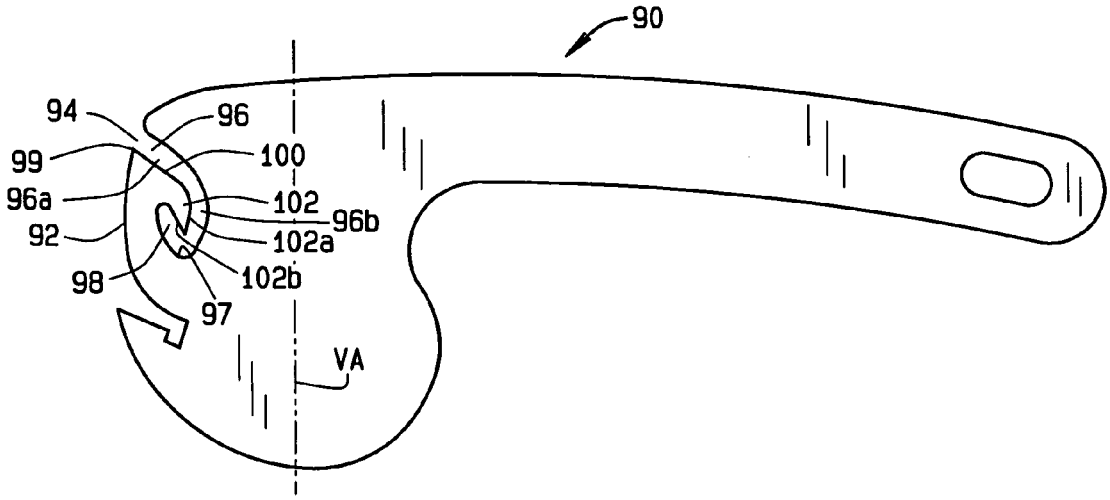
FIG. 7 is a plan view of a fifth illustrative embodiment of the can opener.

The opener 90 in FIG. 7 is somewhat similar to the opener 80 (FIG. 6). The opener 90 includes a curved surface 92 which extends upwardly from the starting notch. A port 94 is formed above the surface 92 in the forward edge of the opener body front. The port 94 opens into a channel 96 which has an initial straight section 96*a* and a curved section 96*b* which leads to the finishing notch 97. The channel 96 then extends generally diagonally upwardly to form a retaining notch 98. The channel section 96*a* is generally flat and intersects with the surface 92 at an acute angle, preferably at a point 99. The channel 96 and notches 97 and 98 are defined or formed in part by a sloped flat surface 100 which extends inwardly from the point 99 and a finger 102 which extends downwardly from the end of the surface 100. As with the opener 10, the surface 100 forms an angle of between about 55° and about 65° with the vertical axis VA of the opener body. The finger 102 has a curved edge 102*a* which forms a surface of the channel 96 and an edge 102*b* which forms a surface of the notches 97 and 98. In this embodiment, the finger 102 and the extended spiral channel 96 form the retainer.

Figure 8:
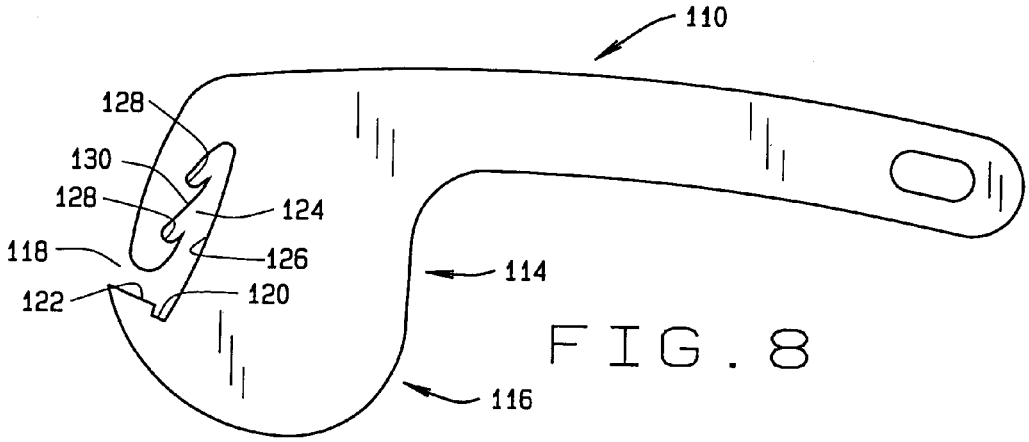
FIG. 8 is a plan view of a sixth illustrative embodiment of the can opener.
Figure 9:
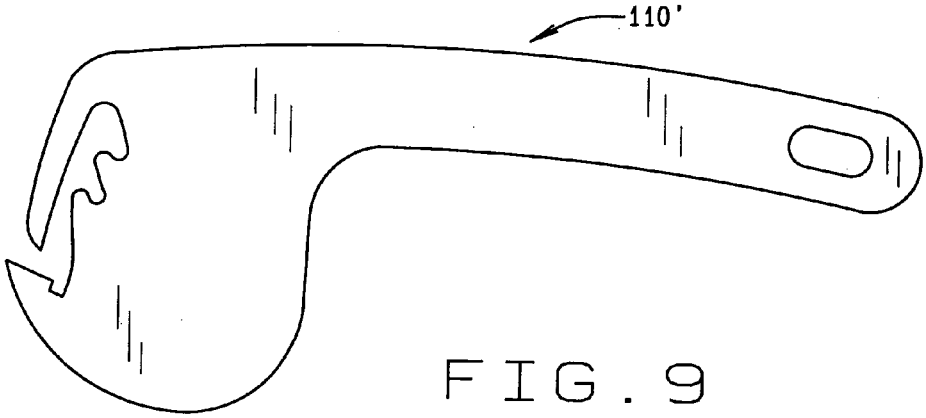
FIG. 9 is a plan view of an seventh illustrative embodiment of the can opener.

The opener 110 of FIG. 8 has a single port, rather than two ports. The opener 110 has a body 114 with a curved heel 116 similar to the heel of the opener 10 (FIG. 1). At the forward end of the heel, the body 114 includes a port 118 which extends rearwardly from the forward edge of the opener body and opens into the starting notch 120. As with the opener 10, the notch 120 is below the surface 122 which defines the port. A channel 124 extends upwardly from the port 118. The channel has a generally smooth back surface 126 and two notches 128 formed in the front surface 130. The notches 128 give the appearance of hook barbs. The two notches 128 define the finishing notches of the opener. The provision of two finishing notches allow for opener 110 to be applied to the pull tab in one of two alternative positions. The user may find one position to be more advantageous than the other depending on the size of the pull tab hole or the size of the pull top lid. In the opener 110, the channel 124 forms the retainer. The finishing notches 128 can also be formed on the back surface of the channel as seen in the opener 110' in FIG. 9.

The operation of the opener 110 is substantially similar to the operation of the opener 10 as described above. Initially, the starting notch 120 is engaged with the pull tab, as described above, and the pull tab is pivoted to break the seal in the can. The starting notch is then disengaged from the pull tab. However, rather than removing the opener from the pull tab, as occurs with the opener 10, the end edge or ring of the pull tab is slid along the channel 124 and a selected one of the finishing notches 128 is engaged with the pull tab. The opener is then pivoted again to pry the lid off the can, as described above.

The opener 130 (FIG. 10) is a variation of the opener 110. The opener 130 also includes a single port 132 which opens into the starting notch 134. A channel 136 extends upwardly from the notch 134. However, the opener 130 has only one finishing notch 138 which extends forwardly and downwardly from the top of the channel 136 to define a hook or barb 140. As seen, the channel 136 bends forwardly near its top as at 139 so that the notch 138 can extend downwardly from the top of the notch to be generally parallel to the main branch of the channel 136. The opener 130 also includes a rebound or retaining slot 142 which extends rearwardly from the channel 136. The notch 138 and the rebound/retaining slot 142 form an angle of about 80° to about 100°. The rebound slot 142 forms the retainer and, should the pull tab bounce when the lid is pried off the can, the tab will move from the finishing notch to the rebound/retainer slot 142. Additionally, it is noted that the body of the opener 130 includes a bump 144 on the top of the body and which extends above the opener's handle. This bump 144 gives the body a somewhat egg-shaped configuration. The opener can be formed without the bump.

Figure 10:
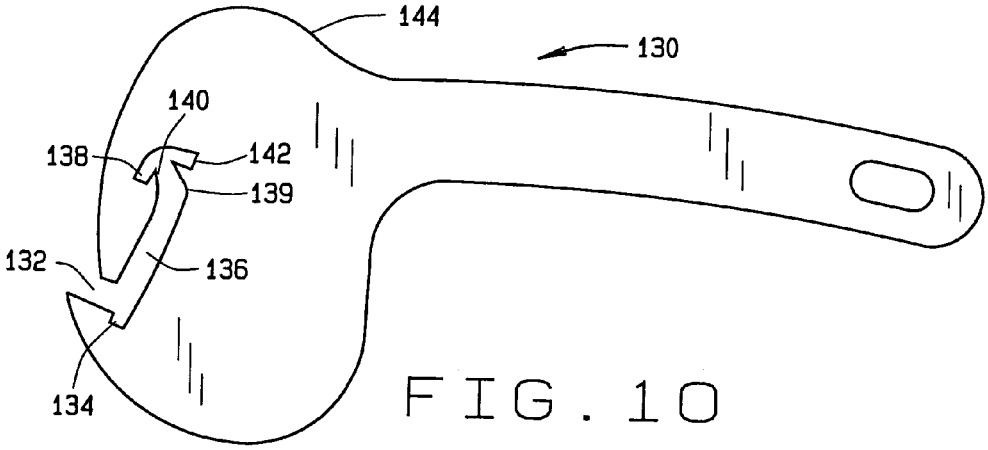
FIG. 10 is a plan view of a eighth illustrative embodiment of the can opener.
Figure 11:
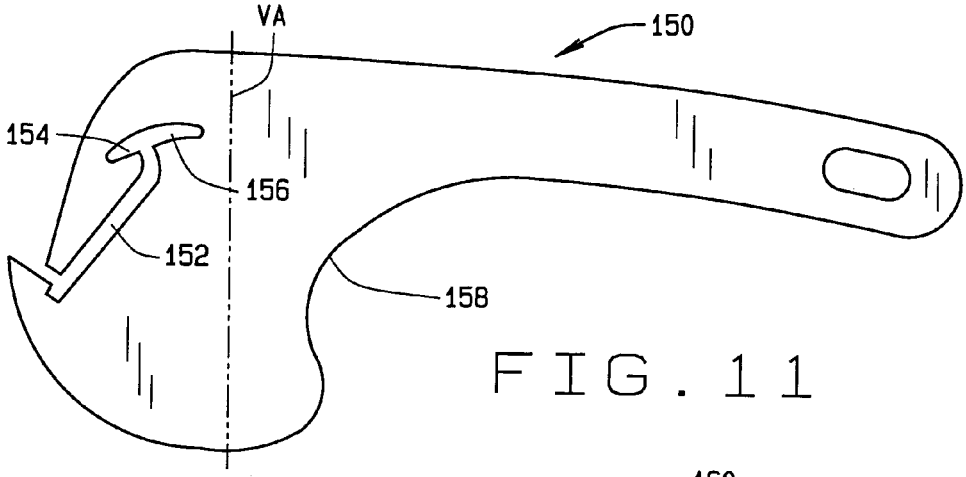
FIG. 11 is a plan view of a ninth illustrative embodiment of the can opener.

The opener 150 (FIG. 11) is also a single port opener, generally similar to the opener 130 (FIG. 10). However, in the opener 150, the channel 152 slopes rearwardly more than does the channel 136. Thus, where the channel 136 (FIG. 10) forms an angle of about 10° to about 20° with the vertical axis VA of the opener 130, the channel 152 forms an angle of about 40° to about 50° with the vertical axis VA of the opener 150. Additionally, the finishing notch 154 slopes more forwardly of the channel 152 (rather than being generally vertical), and the rebound/retainer slot 156 forms an obtuse, rather than an acute, angle with the channel 152. In view of the change of orientation of the channel, the finishing notch and the rebound slot, the finishing slot and rebound notch define an angle of between about 150° and 160°. It will also be noted that the back edge 158 of the body is generally concave from the handle to the bottom of the body. This shape to the back edge of the body forms a seat for the user's hand when the handle is gripped from below, rather than from above.

Figure 12:
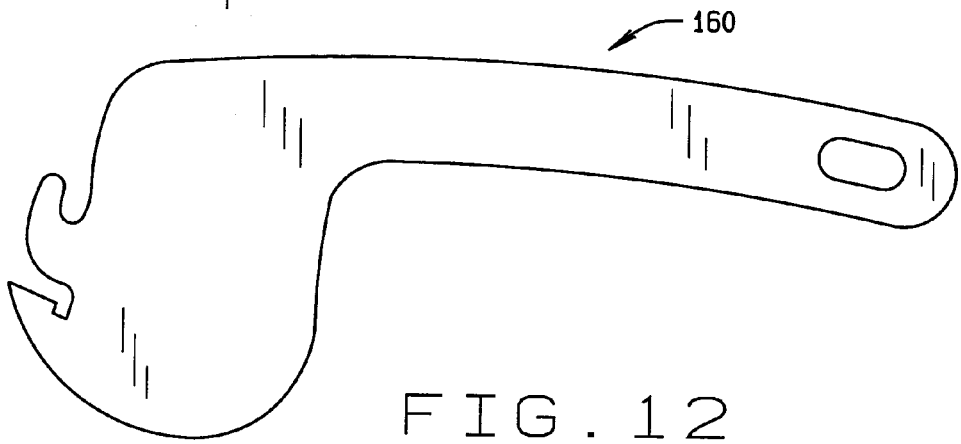
FIG. 12 is a plan view of a tenth illustrative embodiment of the can opener.

The opener 160 (FIG. 12) is similar to the opener 70 (FIG. 5). However, the opener 160 lacks the upper lip or extension of the opener 70, and hence lacks a retainer. Therefore, when the opener 160 is used, the can lid L could pop off the opener. While the opener 160 will work equally as well as the other openers, to remove the lid L from the can C, it lacks a retainer, which, as noted above, is preferably provided so that the lid L does not pop off the opener when the lid is initially freed from the can.

Figure 13:
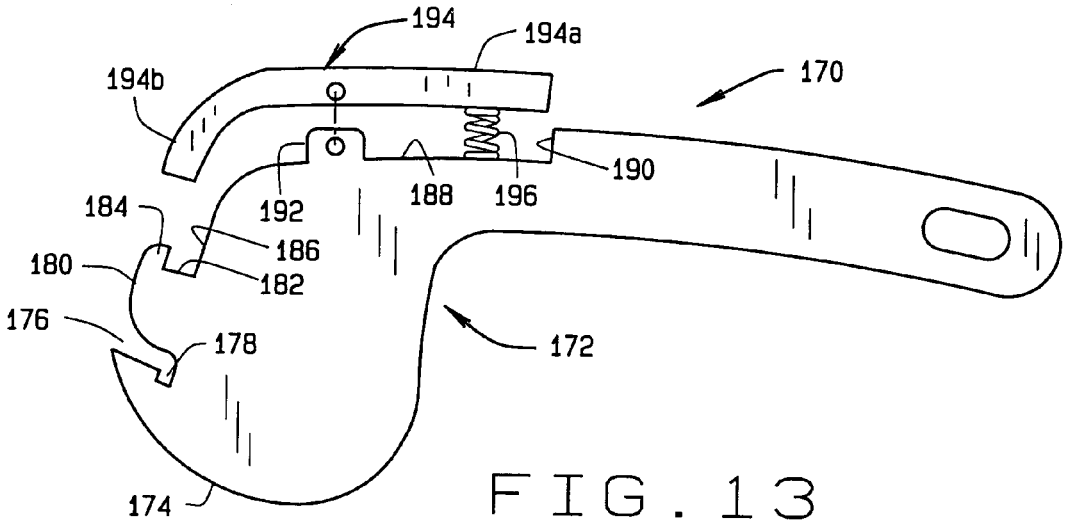
FIG. 13 is a plan view of an eleventh illustrative embodiment of the can opener.

The openers of FIGS. 1 and 3–12 are all one-piece unitary openers with no moving parts. The opener 170 (FIG. 13), as will be described, has a lever which closes the finishing notch and forms the retainer. The opener 170 includes a body 172 having a curved heel 174. A first port 176 opening into a starting notch 178 is formed just above the heel. The forward edge 180 of the body 172 is curved above the port 176, and an upwardly opening finishing notch 182 is formed at the top of the edge 180. The notch 182 is defined in part by a generally vertically extending lip 184. The inner or back surface of the notch 182 is defined by a generally vertical edge 186. The edge 186 curves around to the top edge 188 of the body 172, which is spaced below the top edge of the handle. Hence, a shoulder 190 or step is formed between the handle and the body. A fulcrum 192 extends upwardly from the body top edge 188 between the front of the edge 188 and forwardly of the shoulder 190. A lever 194 is pivotally mounted to the fulcrum 192 approximately midway along the length of the lever. The lever 194 is shaped to correspond generally to the shape of the top and front surface of the body. Hence, the lever 194 includes a generally horizontal portion 194*a* which bends or curves over to a generally vertical portion 194*b*. The lever is pivotal between a first, closed, position in which the end of the lever vertical portion 194*b* engages the top of the lip 184 and a second, opened, position in which the lever vertical portion 194*b* is spaced from the top of the lip 184. Preferably, a spring 196 is provided rearwardly of the fulcrum 192 to bias the lever normally to the first, closed, position. The back end of the lever can be pressed downwardly to move the lever from the first to the second position, and released to allow the lever to move back to the first position under pressure of the spring 196. The spring is shown to be a coil spring, but could be any type of spring material that will bias the lever handle to the closed position. When the lever is moved to its second open position, the space between the end of the vertical portion and the top of the lip define the second port. When the lever is in its first closed position, the lever will retain the lid on the opener when the lid is pried off the can.

In view of the above, it will be appreciated that the various openers are provided. The openers all have a starting notch (or hook) and a finishing notch (or hook) which require repositioning of the opener body relative to the can between lid opening steps. The repositioning of the body to the finishing hook raises the handle to provide additional leverage to the user—thereby making opening of the can easier.

As various changes could be made in the above constructions without departing from the scope of the invention, it is intended that all matter contained in the above description or shown in the accompanying drawings shall be interpreted as illustrative and not in a limiting sense. For example, although it is preferred to provide the opener with a handle, a handle is not necessary. Additionally, as noted in FIG. 12, a retainer is not necessary to the operation of the opener. These examples are merely illustrative.

What is claimed is:

1. A can opener for a pull top-type can, the opener comprising:

a body comprising a forward surface, a rear surface, and a bottom surface, at least said bottom surface being curved to define a generally U-shaped heel;

a tab engaging lip having a flat surface extending rearwardly from an upper, forward end of said heel; said lip flat surface forming an acute intersection with said heel and having a length less then the diameter of a ring of a pull-top can opening tab;

a starting notch at an end of said flat surface opposite said intersection between said flat surface and said heel, said starting notch having a forward surface and a bottom surface; said lip flat surface and said notch bottom surface intersecting with said notch forward surface at opposite ends of said notch forward surface; said starting notch forward surface defining an angle with said lip flat surface to form an abrupt transition between said flat surface and said notch; and a finishing notch at said front surface; said finishing notch being spaced above said starting notch.

2. The can opener of claim 1 including a handle, said body being formed at one end of said handle.

3. The can opener of claim 1 wherein said heel has a first portion defining a first radius extending from said flat surface and a second portion defining a second radius, said second radius continuing from said first radius; said first radius being greater than said second radius.

4. The can opener of claim 1 including a port opening into said starting notch from said front surface; said flat surface defining a lower surface of said port.

5. The can opener of claim 4 wherein said port is a first port, said opener including a second port spaced above said first port; said second port opening into said finishing notch.

6. The can opener of claim 5 wherein said body includes a retaining portion which extends over said opening; said retaining portion being adapted to maintain a can lid on said opener upon removal of the can lid from its can.

7. The can opener of claim 6 wherein said second port defines a spiral path; said second port surfaces defining said retaining portion.

8. The can opener of claim 4 including a channel extending from said starting notch to said finishing notch; said can opener having only a single port.

9. The can opener of claim 8 wherein said finishing notch is on a forward edge of said channel.

10. The can opener of claim 8 wherein said finishing notch is on a rear edge of said channel.

11. The can opener of claim 8 including a rebound slot extending generally rearwardly from said channel.

12. The can opener of claim 1 including an arm pivotally mounted to said body above said finishing notch; said arm having a downwardly extending finger; said arm being movable between a first position in which said finger engages a front edge of said notch to close said notch and a second position in which said finger is spaced above said notch front edge to open said notch.

13. The can opener of claim 12 wherein said arm is spring biased to its first position.

14. A can opener for a pull top-type can, the opener comprising a body comprising:

a forward surface, a rear surface, and a bottom surface, at least said bottom surface being curved to define a generally U-shaped heel;

a tab engaging lip having a surface extending rearwardly from an upper, forward end of said heel; said surface forming an acute intersection with said heel;

a starting notch at a rear end of said tab engaging lip surface opposite said intersection between said lip surface and said heel; said starting notch having a forward surface and a bottom surface; said lip surface and said notch bottom surface intersecting with said notch forward surface at opposite ends of said notch forward surface; said starting notch forward surface defining an angle with said lip surface to form an abrupt transition between said surface and said notch;

a finishing notch at said front surface; said finishing notch being spaced above said starting notch; and a retainer proximate said finishing notch; said retainer being adapted to maintain a can lid on said opener upon removal of the can lid from its can;

the curvature of the generally U-shaped heel being sized such that when a can opening tab is received in the starting notch, pivoting of the can opener about the heel will pivot the tab sufficiently to cause the tab to break the seal of the can lid and the rounded heel is sized such that when the opening tab is received in the finishing notch, pivoting of the can opener about the heel will remove the lid from the can.

15. The can opener of claim 14 including a first port in communication with said starting notch and a second port in communication with said finishing notch; said first port extending from a forward surface of said body to said starting notch; said second port extending from one of said forward surface or an upper surface of said body.

16. The can opener of claim 14 including a port extending from said forward edge of said opener body to said starting notch and a channel extending from said starting notch to said finishing notch.

17. The can opener of claim 14 wherein said retainer is defined by a lip; said lip defining at least a part of a channel extending from said forward edge of said opener body to said finishing notch.

18. The can opener of claim 14 wherein said retainer comprises a pathway extending from said finishing notch toward a surface of said body to define a port in said body surface; said port being above said finishing notch.

19. The can opener of claim 18 wherein said pathway is generally J-shaped.

20. The can opener of claim 19 wherein said J-shaped pathway is a generally inverted J-shaped pathway.

* * * * *